US005309832A

United States Patent [19]

Merkel et al.

[11] Patent Number: 5,309,832

[45] Date of Patent: May 10, 1994

[54] PLATE CHANGING DEVICE AND ASSEMBLY

[75] Inventors: Gerd Merkel, Dielheim-Horrenberg; Christian Compera, Dossenheim; Rudolf Hutzenlaub, Mannheim, all of Fed. Rep. of Germany

[73] Assignee: Heidelberger Druckmaschinen AG, Heidelberg, Fed. Rep. of Germany

[21] Appl. No.: 937,528

[22] Filed: Aug. 28, 1992

[30] Foreign Application Priority Data

Aug. 28, 1991 [DE] Fed. Rep. of Germany ..... 4128538
Jun. 5, 1992 [DE] Fed. Rep. of Germany ..... 4218602

[51] Int. Cl.[5] ..... B41F 27/00
[52] U.S. Cl. ..... 101/216; 101/415.1

[58] Field of Search ..... 101/378, 415.1, DIG. 36, 101/409, 410, 411, 216, 139, 140, 144, 145, 182, DIG. 45, 218, 247

*Primary Examiner*—Edgar S. Burr
*Assistant Examiner*—Ren Yan
*Attorney, Agent, or Firm*—Herbert L. Lerner; Laurence A. Greenberg

[57] ABSTRACT

A plate changing device including a roller disposed parallel to a plate cylinder having a plate lock-up device, fixed positioning device for pressing the roller against the plate cylinder and for inserting a rear edge of a printing plate into the plate lock-up device, and fixed guide means extending in a direction in which the rear edge of the printing plate is insertable in the plate lock-up device and displaceably supporting the roller at ends thereof.

14 Claims, 5 Drawing Sheets

46
3
49
45
44
47
50
2
43
42
48
41
14
1
31

52
53
2
56
54
51
57
50
54
55
14
54
42
1
31
41

PLATE CHANGING DEVICE AND ASSEMBLY

BACKGROUND OF THE INVENTION

1. Field of the Invention

The invention relates to a plate changing device, and more particularly, to such a device having a roller disposed parallel to the plate cylinder and pressable against the plate cylinder by a positioning element, a rear or trailing edge of a printing plate being insertable thereby into a plate clamping or lock-up device.

2. Description of Related Art Including Information Disclosed Under Sections 1.97–1.99

Clamping or locking-up a printing plate on a plate cylinder of a printing machine has heretofore been an operation performed manually by a pressman. Devices for gripping or clamping the printing plate which received therein the front or locking and the rear or trailing edges of the printing plate and which could be opened and closed with a key or a gudgeon were provided for the foregoing purpose. The printing plate was inserted into such devices by hand.

The first advancement in this field was a development of devices for gripping or clamping printing plates which can be opened and closed by pushbutton pressure. By means of these devices, the printing plate is automatically gripped or clamped and subsequently tightened at the front or leading and the rear or trailing edges thereof. The front edge of the printing plate is insertable into the gripping or clamping device by hand, semiautomatically or fully automatically. To insert the rear or trailing edge of the printing plate, a device of the type described at the introduction hereto is required.

Such a device has become known heretofore from Japanese Patent Sho 63-191636. The insertion of the bent rear edge of a printing plate into the gripping, clamping or lock-up device of a printing cylinder is effected in the device of this Japanese patent, by a roller, which is supported on swivelable levers connected to a shaft. Provision is made, in the Japanese patent, for the roller to press the front edge of the printing plate to the surface of the plate cylinder after the front edge of the plate has been locked in place, so that then the rear edge of the printing plate, at the other end of the printing plate, can be inserted into the gripping, clamping or lock-up device of the plate cylinder. During this process, the shaft with the levers and the roller is displaced on a guide rail extending tangentially to the plate cylinder. The roller is pressed against the plate cylinder by means of a cylinder which actuates a rod connected to the levers.

This heretofore known device of the Japanese patent is of complex construction. It has many parts and requires a great amount of construction space, which is undesirable for the relatively narrow space conditions already existing between the printing units. Because of the relatively large amount of space required by the device of the Japanese patent, it is difficult to combine that device with a semiautomatic or fully automatic printing plate feeder. Advancements in automation require such a combination, however, and for reasons of economy, a combination of standardized elements is desirable. Not only the roller, but the shaft, as well, are located directly in front of the printing unit, which should be accessible at all times, for example, if a hickey has to be removed from the printing plate, or if the pressman, for some reason, must manually intervene. The device of the Japanese patent is also unable to be removed in a simple manner in order to gain better access to the printing unit.

SUMMARY OF THE INVENTION

It is accordingly an object of the invention to provide a plate changing device which is of relatively simple construction, occupies relatively little space, relatively minimally impairs accessibility to the printing unit, and is combinable or assemblable as a standardized element with either a semiautomatic or fully automatic printing plate feeder.

With the foregoing and other objects in view, there is provided, in accordance with the invention, a plate changing device comprising a roller disposed parallel to a plate cylinder having a plate lock-up device, fixed positioning means for pressing the roller against the plate cylinder and for inserting a rear edge of a printing plate into the plate lock-up device, and fixed guide means extending in a direction in which the rear edge of the printing plate is insertable in the plate lock-up device and displaceably supporting the roller at ends thereof.

In accordance with more specific features of the invention there is provided a machine frame, the guide means comprise a pair of guides secured to the machine frame, and the positioning means comprise two positioning elements firmly connected to the machine frame and supporting the roller at each of the ends thereof, respectively.

An advantage of the invention is that it is distinguished both by its relatively simple structure and by relatively good accessibility to the printing unit, as well as by relatively high functional reliability. The device according to the invention has very few parts and can therefore, be manufactured relatively economically. The roller is the only structural features or component which comes to rest in front of the printing unit. However, as a rule, this does not hinder the pressman. A combination or assembly of the device according to the invention with a device for semiautomatic printing plate feeding, or a device for fully automatic printing plate feeding, is readily possible without having to modify the device according to the invention for that purpose. Such a combination or assembly of standardized elements is especially economical.

In accordance with a further feature of the invention the roller has means for removing it from the device of the invention by an operator without having to use a tool.

In accordance with more detailed features of the invention, the means for removing the roller from the device are afforded by providing a pair of displaceable bearings respectively holding the roller in the pair of guides, the roller being removable from the bearings.

In accordance with an added feature of the invention, the bearings are formed of respective journals, and receptacles wherein the journals are receivable.

In accordance with an additional feature of the invention, the journals are attached to the roller, and the receptacles are disposed in the guide members.

In accordance with yet a further feature of the invention, at least one of the journal receptacle is mounted so a to be axially displaceable and spring means are included for biasing the one journal receptacle a distance in axial direction so that, due to an axial displacement of the roller, the journal for the one journal receptacle is located outside the one journal receptacle, the journal and the one journal receptacle in mutually engaging condition, having, respectively, a matching spherical and concave construction enabling outward swiveling of the roller.

In accordance with yet another feature of the invention, at least one of the journals is mounted so as to be axially displaceable, and spring means are included for biasing the one journal a distance in axial direction so that, due to an axial displacement of the roller, the journal for the one journal receptacle is located outside the one journal receptacle, the journal and the one journal receptacle in mutually engaging condition, having, respectively, a matching spherical and concave construction enabling outward swiveling of the roller.

Thus, the aforedescribed bearings may, for example, be formed of journals or journal pins and journal seats or receptacles, it being possible to connect the journals to the shaft and to dispose the journal seats in the guides, or the reverse. It is also possible to provide a different arrangement on the one side and on the other side. An essential feature of the construction is that the roller is readily removable from the bearings. This can be achieved, for example, by constructing the journal seat or receptacle of two halves, one of the halves being swingable out of the way with a simple handle or manipulation, or a device is provided which can shorten the length of the shaft between the bearings, or the bearing parts connected to the machine frame are movable apart.

In accordance with yet another feature of the invention, the displaceable journal and the displaceable journal seat or receptacles, respectively, are provided on at least one of the bearings; this may be possible both on the roller, as well as, on the guides.

In accordance with yet an added feature of the invention, the printing plate is rollable on the plate cylinder by the roller for mounting the printing plate on the plate cylinder.

The device thus affords inserting the bent rear edge of a printing plate into the plate lock-up or clamping device of the plate cylinder, but also so that, as a printing plate is drawn onto the plate cylinder, the roller rolls the printing plate over the plate cylinder. Accordingly, the printing plate presses especially closely against the surface of the plate cylinder.

In accordance with yet an additional feature of the invention, the roller, in a condition thereof wherein it is spaced from the plate cylinder, serves as a guide for introduction of the printing plate.

In accordance with still another feature of the invention, the positioning elements are pneumatic cylinders. This is advantageous because compressed air is available in the printing machine, pneumatic cylinders are well controllable, and simultaneous, fast actuation is possible. Because the pneumatic system has a resilient property, assurance is provided that the roller will be in parallel engagement with the plate cylinder, and the plate will thereby fit exactly into the clamping or lock-up device over the entire width thereof.

Because such pneumatic cylinders are limitedly able only to absorb axial forces, in accordance with another feature of the invention, the bearing means have displaceable supports at the machine frame for absorbing axial forces of the roller.

In accordance with a further feature of the invention, the supports have respective balls rotatably engaging a surface of the machine frame. This keeps the friction as low as possible during the adjustment.

In accordance with an added feature of the invention, there are provided respective bushings displaceable by the positioning elements, the bearings being disposed in the bushings, the bushings being displaceable by the guides radially to the plate cylinder. Thus, the bushings are guided in the insertion direction of the rear edge of the printing plate by the guides.

In accordance with an additional feature of the invention, there are provided spring means in the bushings, the bearings being displaceable outwardly from the plate cylinder against a biasing force of the spring means, the biasing force being of such size that danger of injury to a hand present between the plate cylinder and the roller is minimal.

Additional reliability is afforded in accordance with yet other features of the invention, which are a switch for signalling stoppage of the printing machine, and lever means for transmitting a displacement of the bearings in the bushings to the switch.

In accordance with still a further feature of the invention, the roller is formed of an inner and an outer tube, the inner tube receiving therein part of the bearings, and roller bearings supporting the outer tube on the inner tube.

Due to this construction of the roller, it is readily rotatable, and damage due to sliding of the printing plate on the roller is avoided.

For handling the printing plate as gently as possible, in accordance with still an additional feature of the invention, the roller is formed with projecting rings of elastic material disposed over the cylindrical surface of the roller. The spacing between these rings must be kept so small that a uniform force is exerted upon the printing plate over its entire width.

In accordance with a more specific feature of the invention, the elastic material is rubber.

Thus, the device according to the invention can be used in a manner that printing plates, fed manually to the lock-up device for gripping or clamping the front edge of the printing plate and wound around the plate cylinder are introduced by their bent rear edge into the device for locking-up or gripping the rear edge of the printing plate into place automatically, with the roller.

The device according to the invention may also thus possibly be used in printing units wherein the printing plate is fed to the plate cylinder by means of a semiautomatic device. Then, although the front edge of the printing plate continues to be introduced manually into the lock-up device for gripping or clamping the front edge of the printing plate in place, the printing plate, however, is held and guided while the plate cylinder winds up the printing plate. During the feeding of an end region of the printing plate which is no longer guided through the semi-automatic apparatus, the roller serves to guide the printing plate. After that, the roller automatically introduces the rear or trailing edge of the printing plate into the device for locking or clamping it in place.

In the same manner, the device of the invention can also be combined with a fully-automatic device which, by means of suction cups and transport devices feeds the printing plates to the plate cylinder and removes them therefrom. A control system then provides for appropriate sequential actuation of devices for feeding, removing, locking-up and unlocking or releasing, and the actuation of the roller to insert the rear edge of the printing plate.

Other features which are considered as characteristic for the invention are set forth in the appended claims.

Although the invention is illustrated and described herein as embodied in a plate changing device and assembly, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying drawings, in which.

DESCRIPTION OF THE PREFERRED EMBODIMENTS

Figure 1:
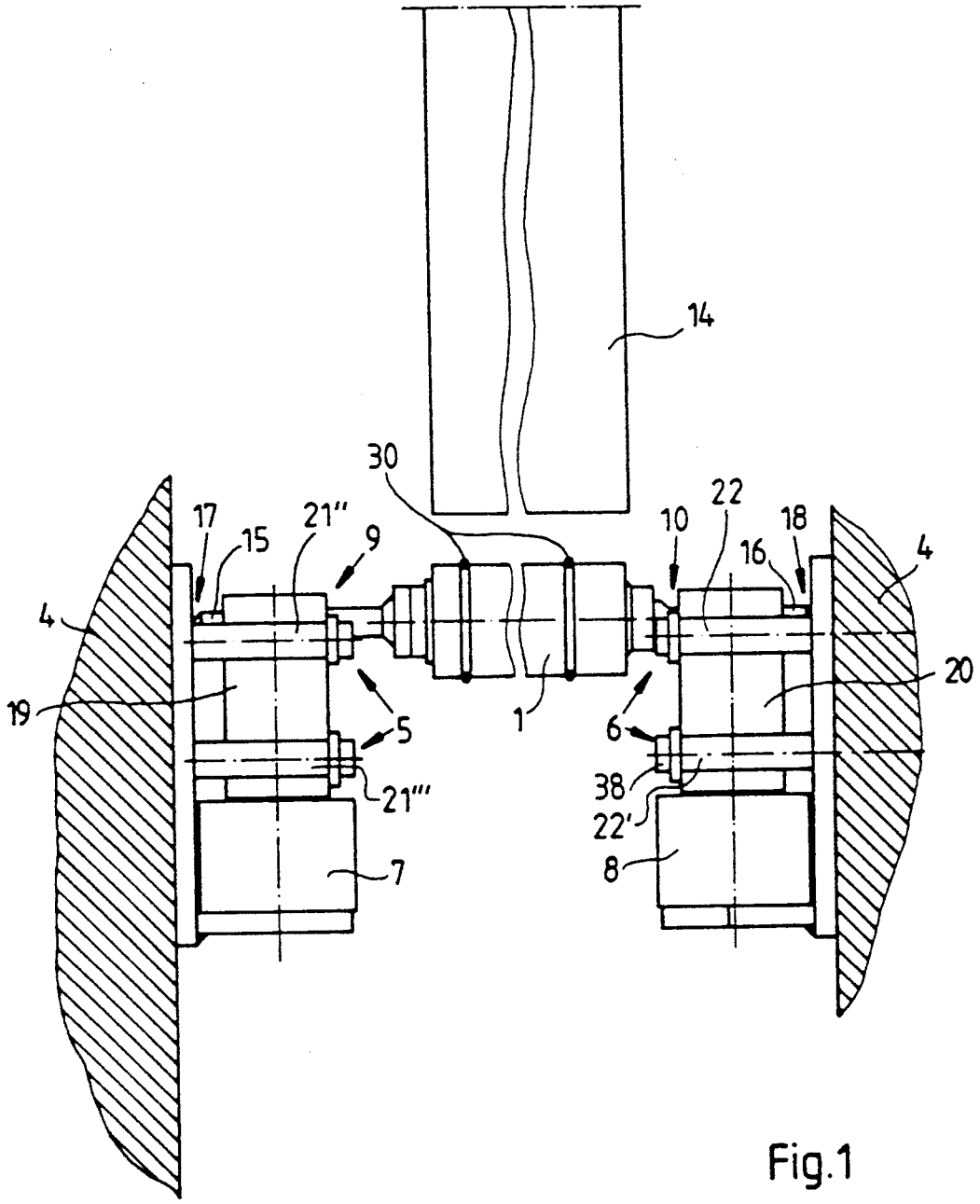
FIG. 1 is a diagrammatic plan view of the plate clamping device according to the invention.

Referring now to the drawings and, first, particularly to FIG. 1 thereof, there is shown therein, in a diagrammatic view, a device for changing printing plates, wherein roller 1 is disposed parallel to a plate cylinder 14 of a printing machine. The roller 1 and the plate cylinder 14 are shown greatly foreshortened. The roller 1 is mounted by its ends in bearings 9 and 10 and is displaceable in a direction in which a rear bent edge 3 of a printing plate 2 is insertable by means of guides 5 and 6, as shown, for example, in FIG. 3. The guides 5 and 6 which are formed of guide elements 21, 21', 21'', 21''', 22, 22', 22'', 22''', are firmly connected to the side walls of the machine frame 4. The displacement of the roller 1 is performed by positioning elements 7 and 8. The bearings 9 and 10 are disposed in sleeves or bushings 19 and 20, which are guided by the guide elements 21, 21', 21'', 21''', 22, 22', 22'', 22'''. To this end, the bushings 19 and 20 have a square-shaped cross-section, for example, and the guide elements 21, 21', 21'', 21''', 22, 22', 22'', 22''' run over respective side surfaces thereof. Each of the bushings 19 and 20 is equipped with two pairs of such guide elements, although only the forward guide elements 21'', 21''', 22, 22' are visible in FIG. 1. Supports 15 and 16 with respective balls 17 and 18 (note, FIG. 2) provide for the absorption of the axial forces due to the bracing action at the side walls of the machine frame 4. The positioning elements 7 and 8 are secured by angles to the side walls of the machine frame 4 and are joined by adjustable parts thereof to the bushings 19 and 20 so that only longitudinal or axial forces can be transmitted. Upon actuation, the bushings 19 and 20 are moved in a direction towards the plate cylinder 14 until the roller 1, by means of rings 30 thereof, has effected the insertion of the bent rear edge 3 of the printing plate 2 into a clamping or lock-up device 31 of the plate cylinder 14. There are actually a greater number of rings 30 on the roller 1 than are illustrated in FIG. 1, however, the others are not visible because only the outer ends of the roller 1 are shown.

Figure 2:
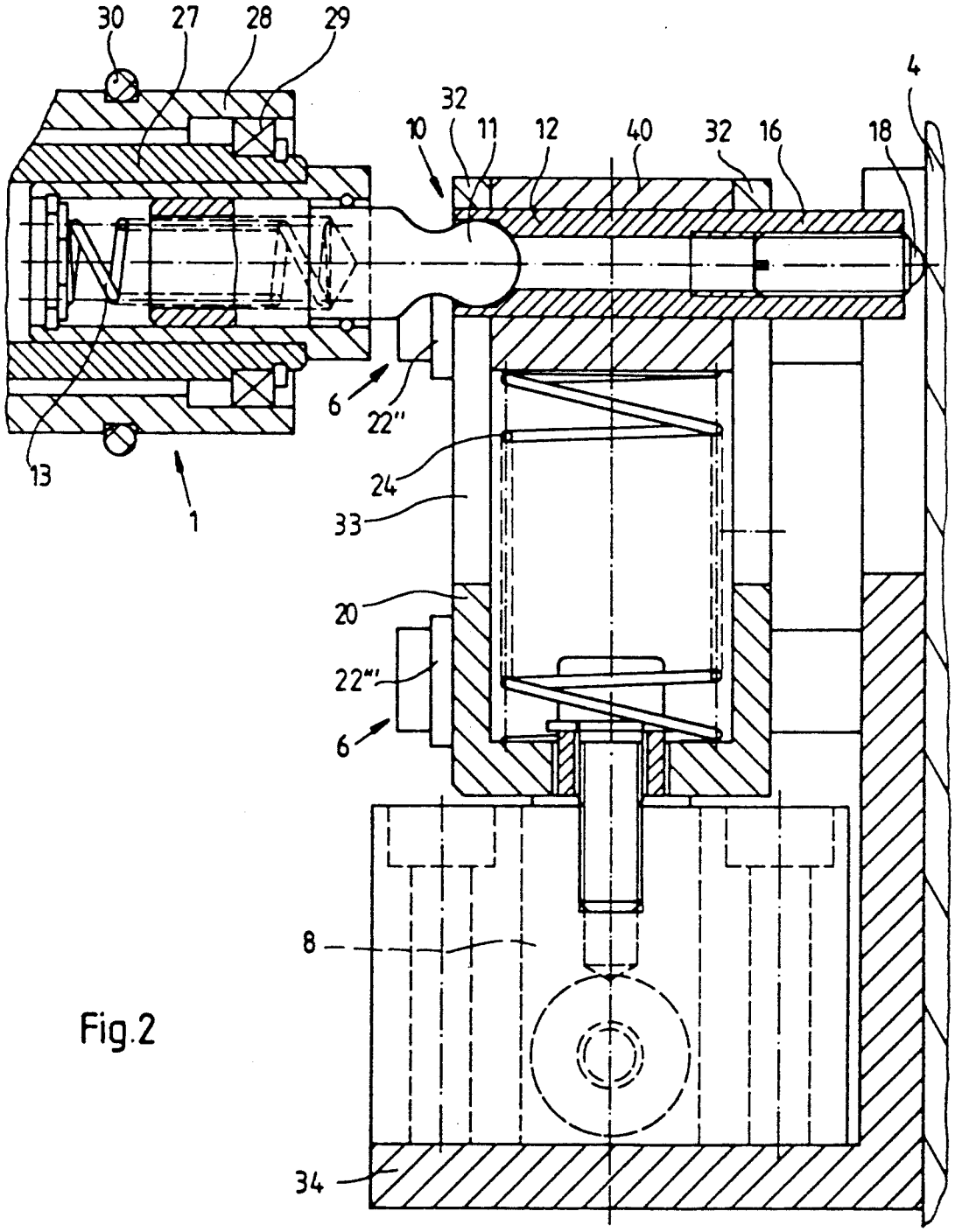
FIG. 2 is an enlarged fragmentary detailed view of FIG. 1 showing one end of a roller forming part of the inventive device with a bearing, guide and positioning element thereof.

FIG. 2 shows the one end of the roller 1 illustrated at the right-hand side of FIG. 1, together with its bearing, guide and positioning element. The bearing 10 is formed of a journal 11, which is supported axially displaceably in an inner tube 27 of the roller 1, and can be pressed into the inner tube 27 against the force of a spring 13. This journal 11 is disposed in a journal receptacle 12, which is fitted into the bush 20. The journal 11 can be inserted counter to the spring 13 such a distance into the inner tube 27 of the roller 1 that the journal at the other non-illustrated end of the roller 1 can be moved out of the non-illustrated journal receptacle thereof and, as a result, the roller 1 can be swiveled away from the printing unit. To ensure that this swiveling motion will occur, the journal 11 is provided with a spherical surface, and the journal receptacle 12 has a concave, calotte-shaped construction matching the spherical surface. The journal 11 is retained in the tube 27 by means of a suitable stop.

In the axial direction, the journal receptacle 12 is adjoined by a support 16, which has a rotatable ball 18 on a free end thereof which can run or travel on one face of the machine frame 4. This support 16 provides for the absorption of axial forces, and an identically constructed support 15 (as shown in FIG. 1) is also provided at the other end of the roller 1.

The bushing 20 contains a spring 24 which presses the journal receptacle 12 against a wall 32 of the bushing 20 which faces towards the plate cylinder 14. The journal receptacle 12 is radially displaceable in the bushing 20, as viewed from the plate cylinder 14, and the receptacle opening for the journal 11 remains free due to the provision of a recess 33 in the bushing 20. Exact displaceability of the journal receptacle 12 in the bushing 20 is attained by a piston-like slide element 40, which carries the journal receptacle 12 and slides in the bushing 20. The spring 24 has a spring force of such value that, when the roller 1 is used as intended, the spring 24 holds the journal receptacle 12 at the wall 32, but in the event that a hand of the operator or pressman should get in between the plate cylinder 14 and the roller 1, the spring 24 is compressed, so that the danger of injury is kept as slight as possible. The bushing 19 at the other end of the roller is constructed accordingly.

FIG. 2 also shows the construction of the roller 1. It is formed of an inner tube 27 and an outer tube 28, the inner tube 27 accommodating the parts of the bearing at the side of the roller 1. In this case, it is the journal 11. Between the outer tube 28 and the inner tube 27 are roller bearings 29, which provide for easy rotatability of the outer tube 28. The surface of the outer tube 28 of the roller 1 is formed with circular grooves wherein rings 30 of elastic material are disposed so that they protrude past the surface of the roller 1. Although not illustrated in FIG. 2, a number of such rings 30 are disposed over the length of the roller 1, indeed, as many of such rings as is necessary for the roller 1 to press the bent rear or trailing edge 3 of the printing plate 2 (FIG. 3) into the clamping device 31 of the plate cylinder 14, and the entire surface of the printing plate 2 against the plate cylinder 14 with uniform force, respectively.

The positioning element 8 is screwed to an angle 34, which is firmly joined to the machine frame 4.

The bearing of the roller 1 at the non-illustrated opposite side of the roller 1 is of similar construction as that of the side illustrated in FIG. 2, yet it is sufficient merely for the journal at only one of the sides to be axially displaceably supported opposite to the force of a spring. In such a case, it is then not absolutely necessary for the nondisplaceable journal and the journal receptacle appertaining thereto, respectively, to have a spherical or calotte-like construction. Nevertheless such constructions are advantageous in avoiding damage.

Figure 3:
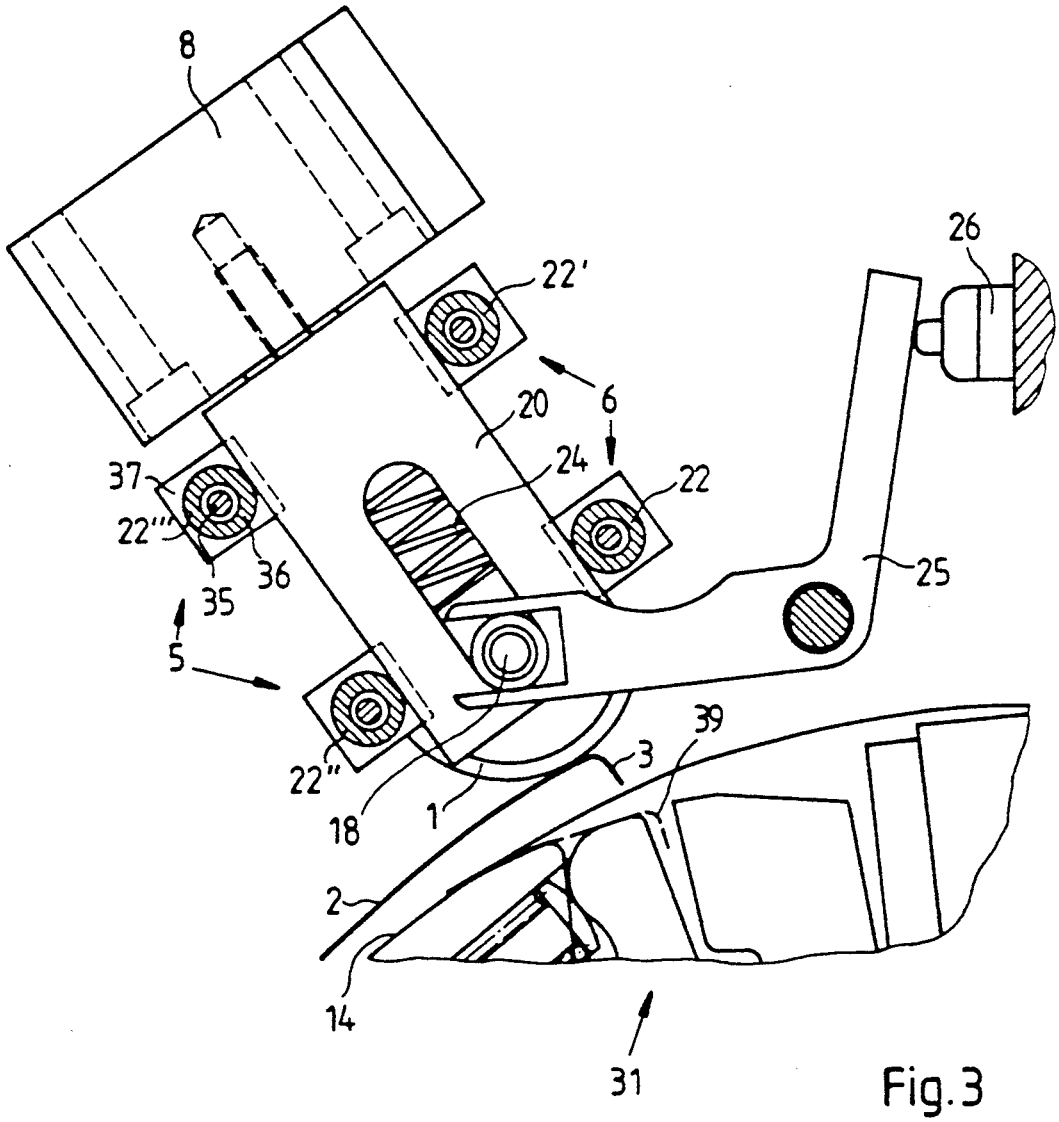
FIG. 3 is a reduced fragmentary electrical view of the device as seen from the right-hand side of FIG. 2, in an operation phase thereof wherein a bent edge of a printing plate is being inserted into a clamping unit of the device.

FIG. 3 is a view of the device according to the invention just before the rear or trailing edge 3 of the printing plate 2 has been received. FIG. 3 shows the positioning element 8 but omits the angle 34, and also shows the guide elements 22, 22', 22'', 22''' in section. The viewing direction is toward an end or side of the roller 1; parts of the bearing thereof at that end being illustrated. In this view, the paired arrangement of guide elements 22, 22', 22'', 22''' is readily apparent. All the guide elements are screwed into the side wall 4 (not shown in FIG. 3). To illustrate the advantageous construction of the guide elements, they have been shown in section, as aforementioned. They each include a threadedly secured screw 35 and an easily rotatable bushing 36 which is slipped over the screw 35. Retaining disks 37 on each guide element assure that the bushing 20 is also guided in the direction of the axis of the roller 1. The retaining disks 37 are retained by the heads 38 (FIG. 1) of the screws 35.

The printing plate 2 is shown in a position thereof wherein it is wrapped around the plate cylinder 14, its trailing or rear edge 3 having yet to be inserted into the clamping device 31. The bushing 20 is displaced in a direction towards the plate cylinder 14 by actuation of the positioning element 8. Simultaneously, the non-illustrated bushing 19 at the other end of the roller 1 is similarly displaced. The rear or trailing edge 3 of the printing plate 2 is thus brought into the position 39 thereof shown in broken lines, wherein the rear or trailing edge 3 is located in the lock-up or clamping device 31. The clamping device 31 is then closed, the rear or trailing edge 3 of the printing plate 2 is accordingly clamped or locked up, and the printing plate 2 is tightened around the plate cylinder 14 by means of the clamping device 31.

FIG. 3 shows the spring 24 in the bushing 20, which keeps the bearing 10 (FIG. 2) of the roller 1 in a position wherein it faces towards the plate cylinder 14. As described hereinbefore, this feature provides for protection against injury to the hand of an operator or pressman which may have inadvertently strayed between the plate cylinder 14 and the roller 1, due to the fact that the roller 1 can yield counter to the spring 24. A pivotable lever 25 supported in the machine frame 4 is connected at one end thereof to the bearing of the roller 1 and is so constructed that, upon the occurrence of such a yielding or deflection by the roller 1, a switch 26 at the other end of the lever 25 is actuated, so that a signal is transmitted due to the closing of the switch 26 which causes the printing machine to stop. In the interest of clarity and simplicity, the lever 25 has been omitted from FIGS. 1 and 2.

For pressing the printing plate 2 against the plate cylinder 14 during the entire insertion process, the roller 1 may also be actuated by the positioning elements 8 immediately after the non-illustrated front o leading edge of the printing plate 2 has been inserted, in order to ensure a flush contact of the printing plate 2 with the plate cylinder 14. If this function is provided, the roller 1 must be moved away from the plate cylinder 14 shortly before the rear or trailing edge 3 of the printing plate 2 is reached, in order to be able thereby to insert the bent rear or trailing edge 3 of the printing plate 2 into the clamping device 31 and advance it in that manner to the position 39 thereof.

Figure 4:
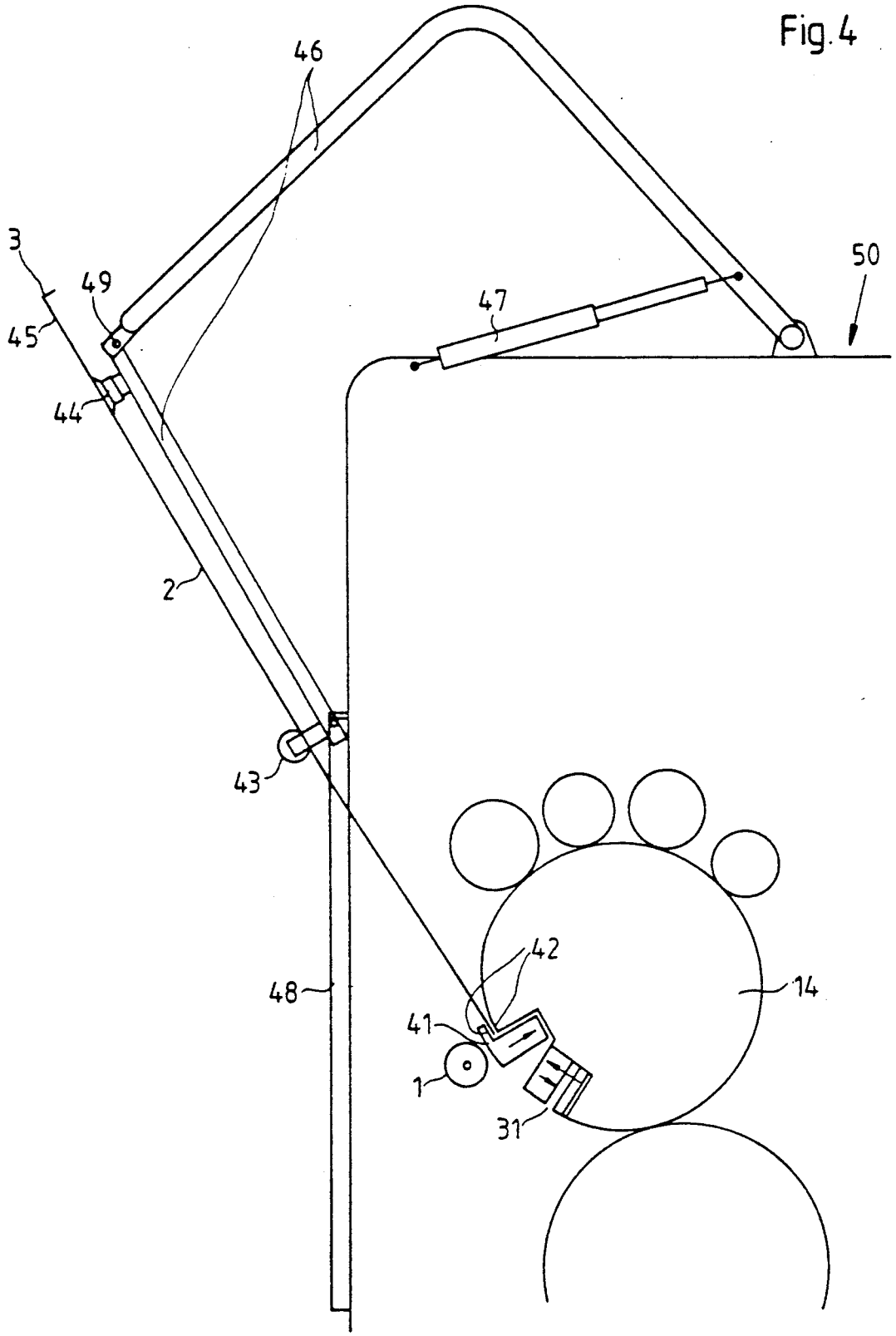
FIG. 4 is a greatly reduced diagrammatic view of the device for inserting the bent rear edge of the printing plate according to FIG. 3, in combination or assembled with a device for semiautomatically feeding a printing plate thereto.

FIG. 4 illustrates a combination or assembly of the hereinaforedescribed device for inserting the bent rear or trailing edge 3 of the printing plate 2 with a semiautomatic printing plate feeding or supply device. A printing unit 50 is shown diagrammatically, wherein a plate cylinder 14 is located. The plate cylinder 14 is equipped with a device 4 for clamping the leading or front edge of the printing plate 2 in place and with a clamping or lock-up device 31 for clamping the rear or trailing edge of the printing plate 2 in place. The semiautomatic printing plate feeding device includes at least one roller 43, which is arranged so that, in the plate changing position, a printing plate 2 tangent to and guided by the roller 43 is disposed substantially on a straight line which, extending parallel to the clamping faces 42 of the device 41 for changing the front or leading edge of the printing plate 2 in place, passes between these clamping faces 42 and extends obliquely upward out of the printing unit 50. The roller 1 is disposed at the lower end of this straight line, as viewed in FIG. 4, with a slight lateral offset therefrom. To feed the printing plate 2 to the plate cylinder 19, the pressman moves the front or leading edge of the printing plate 2 past the roller 43 and between the latter and the printing unit 50, and inserts the front or leading edge of the plate 2 into the space between the clamping faces 42 which is provided for receiving the front or leading edge of the printing plate 2 therein. Accurate positioning of the printing plate 3 is afforded by providing conventional register pins in the device 41 for clamping the front or leading edge of the printing plates 2 into position; these pins cooperate with conventional U-shaped recesses formed in the printing plates 2. By pressing a pushbutton, the pressman initiates the closure of the device 41, which is followed by a single rotation of the plate cylinder 14, which causes the printing plate 2 to be wound onto the plate cylinder 14. Once the trailing or rear edge 3 of the printing plate 2 has passed the roller 43, it drops downwards of its own weight, and is caught by the roller 1. The roller 1 guides the printing plate 2 and then serves for inserting the trailing or rear edge 3 of the printing plate 2 in the aforedescribed manner. Once the rear or trailing edge 3 of the printing plate 2 has been introduced into the lock-up or clamping device 31, the latter device closes, clamping the printing plate 2 into place, and then the printing plate is tightened by a movement in the circumferential direction.

As shown in FIG. 4, the device for semiautomatically feeding or supplying printing plates is further constructed as follows: The at least one roller 43, which is advantageously constructed as a readily rotatable cylinder which has the same width as that of the printing plate 2, is disposed on a lower part of a bipartite printing-unit guard 46. It is so far from the printing unit guard 46 that the bent trailing or rear edge 3 of the printing plate 2 can move past the printing unit guard 46. The lower part of the bipartite printing unit guard 46, in the folded-up state, assumes a position in which it is parallel to the aforementioned straight line. In this manner, by folding up the printing unit guard 46, the roller 43 can be brought into its plate changing position. For printing plates of suitable length, a suction cup 44, against which the printing plate 2 can be pressed, is disposed on the upper end of this lower part of the bipartite printing unit guard 46. The suction cup 44 is constructed so that the printing plate 2 can slide thereon. The printing plate 2 is formed with a bore 45 located in front of the bent rear or trailing edge 3 of the printing plate 2. Printing plates customarily are formed with bores in this region, because such bores are necessary both for the copying process and for stamping out the U-shaped recesses. The presence of this bore 45 is exploited for the purpose of venting or bleeding the suction cup 44. Assurance is thereby provided that the suction cup 44 will release the printing plate 2 at the proper time, causing the printing plate 2 to sag a short distance downwardly of its own weight, so that the rear or trailing edge 3 of the printing plate 2 can slide under the suction cup 44. Printing plates of suitable length can be manipulated by means of this suction cup 44. If the rear or trailing edge 3 of the printing plates 2 moves underneath the roller 43, the printing plate 2 then drops a distance downwardly again and is caught by the roller 1, which guides it until the trailing or rear edge 3 of the printing plate 2 is introduced into the clamping device 31. The introduction of the rear or trailing edge 3 is performed by the roller 1 in the aforedescribed manner. FIG. 4 also shows that the bipartite printing unit guard 46 has a hinge 49, by means of which an angular-shaped arm is pivotably secured to the printing unit 50 at one end thereof and guided at the lower end on the printing unit 50 by means of a guide 48. A gas compression spring 47, or a pneumatic element such as an hydraulic cylinder disposed in its place, serves to keep the printing unit guard in its upwardly-folded position and to advance it to that position, respectively.

Figure 5:
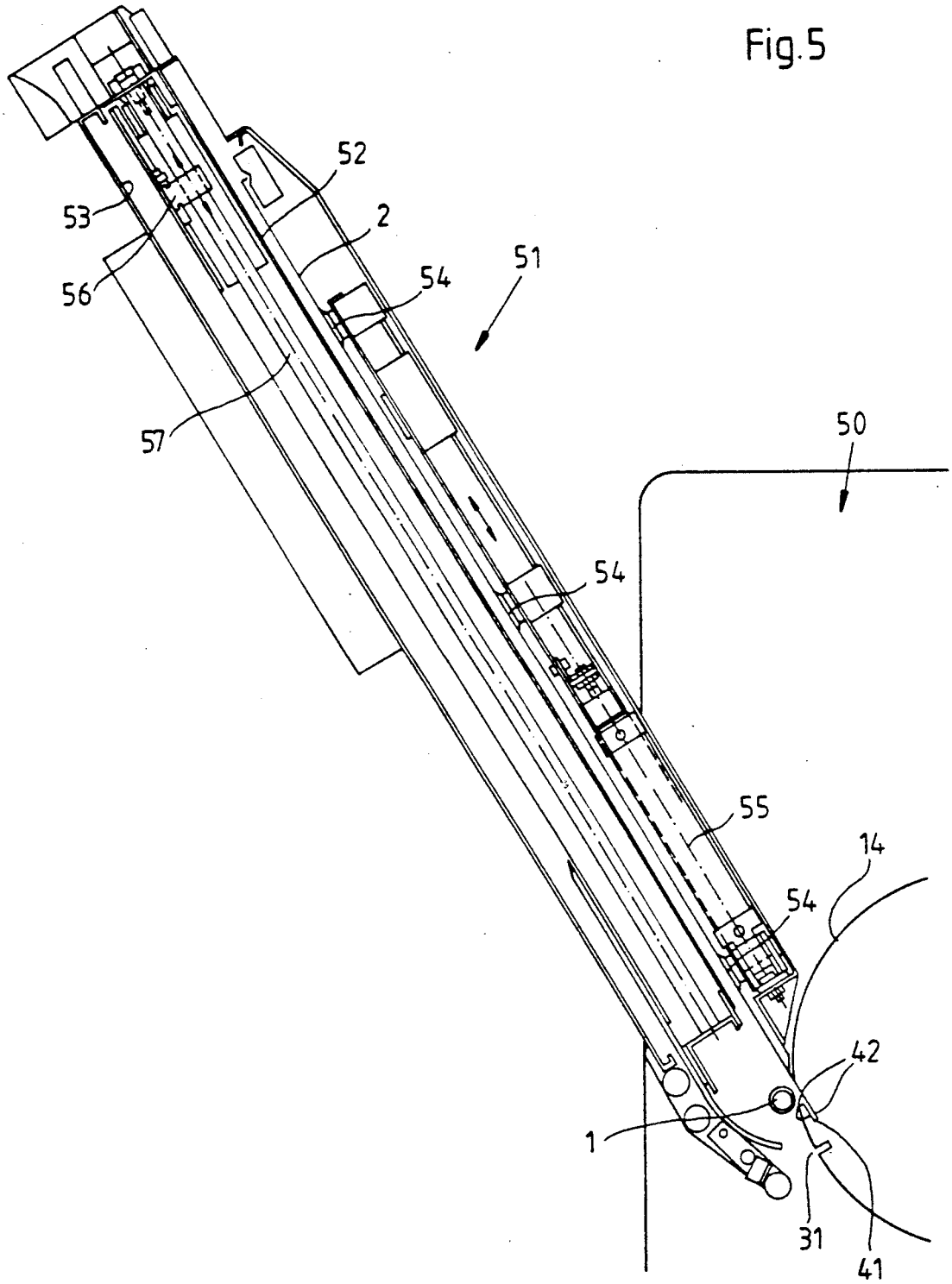
FIG. 5 is a view like that of FIG. 4 of another embodiment of the combination or assembly wherein a device for fully automatically feeding and removing the printing plate has been substituted for the semiautomatic device.

FIG. 5 shows the combination or assembly of the hereinaforedescribed device for inserting the bent rear or trailing edge 3 of the printing plate 2 with a device for fully automatically feeding and removal of printing plates. The latter device includes a magazine 51 for holding used printing plates which have been removed from the machine, and for new printing plates which can be fed to the machine. Advantageously, this magazine 51 is constructed so that a cassette 52 for holding a plurality of new printing plates is accommodated in one chamber of the magazine 51, and a cassette 53 for holding a plurality of old printing plates is located in a different chamber of the magazine 51. Above the cassette 52 for the new printing plates, is a transport device 55 for new printing plates, which has a plurality of suction cups 54 for grasping a new printing plate.

The feeding or supply of new printing plates is performed by the pressman who first inserts a cassette 52 with a plurality of new printing plates 2 into the magazine 51, then the suction cups 54 are lowered and grasp or grip the printing plate 2, initially raise it, and then, by means of the transport device 55, insert it into the device 41 for clamping the front or leading edge of the printing plate 2 into place. The suction cups 54 are moved along a straight line extending between the clamping faces 42 which, in order to receive the front or leading edge of the printing plate 2, are in a clamping position, and have a gap therebetween for receiving the plate 2 therein. Once the printing plate 2 has been introduced, it is clamped in place by the device 41 for securing or clamping the front or leading edge of the printing plate 2 in place and is wrapped around the plate cylinder 14. The rear or trailing edge 3 of the printing plate 2 is inserted into the lock-up or clamping device 31 by the roller 1 in the hereinaforedescribed manner. In FIG. 5, the clamping device 31 and the clamping device 41 are shown only diagrammatically. To remove the printing plates 2, they are released by the clamping device 31 and pushed into a lower part of the magazine 51, as shown in FIG. 5. They are engaged thereat by one or more suction cups 56 and transported by means of the transport device 57 until they are able to be deposited in the cassette 53 for receiving old printing plates.

FIGS. 4 and 5 show how the plate changing device according to the invention can be combined or assembled together with either a device for semiautomatically feeding or supplying printing plates and for removing used plates, without requiring structural changes to be made in the plate changing device. In this manner, it is possible to combine or assemble this plate changing device, as a standardized component or element, with either the semiautomatic device or the fully automatic device.

We claim:

1. Plate changing device comprising a roller disposed parallel to a plate cylinder having a plate lock-up device, positioning means for pressing the roller against the plate cylinder and for inserting a rear edge of a printing plate into said plate lock-up device, and guide means extending in a direction in which the rear edge of the printing plate is insertable in said plate lock-up device and displaceably supporting said roller at ends thereof, said guide means comprising a pair of guides secured to a machine frame, said positioning means comprising two positioning elements firmly connected to said machine frame and supporting said roller at each of said ends thereof, respectively, a pair of displaceable bearings respectively holding said roller in said pair of guides, said roller being removable from said bearings, said bearings being formed of respective journals, and receptacles wherein said journals are receivable, at least one of said journals being mounted so as to be axially displaceable, and including spring means for biasing said one journal a distance in axial direction so that, due to an axial displacement of said roller, the journal for said one journal receptacle is located outside said one journal receptacle, said journal and said one journal receptacle in mutually engaging condition, having, respectively, a matching spherical and concave construction enabling outward swiveling of said roller.

2. Plate changing device according to claim 1, wherein said journals are attached to said roller, and said receptacles are disposed in said guides.

3. Plate changing device according to claim 1, wherein the printing plate is rollable on the plate cylinder by said roller for mounting the printing plate on the plate cylinder.

4. Plate changing device according to claim 1, wherein said roller, in a condition thereof wherein it is spaced from the plate cylinder, serves as a guide for introduction of the printing plate.

5. Plate changing device according to claim 1, wherein said positioning elements are pneumatic cylinders.

6. Plate changing device comprising a roller disposed parallel to a plate cylinder having a plate lock-up device, positioning means for pressing the roller against the plate cylinder and for inserting a rear edge of a printing plate into said plate lock-up device, and guide means extending in a direction in which the rear edge of the printing plate is insertable in said plate lock-up device and displaceably supporting said roller at ends thereof, said guide means comprising a pair of guides secured to a machine frame, said positioning means comprising two positioning elements firmly connected to said machine frame and supporting said roller at each of said ends thereof, respectively, a pair of displaceable bearings respectively holding said roller in said pair of guides, said roller being removable from said bearings, said bearings having displaceable supports at said machine frame for absorbing axial forces of said roller.

7. Plate changing device according to claim 6, wherein said supports have respective balls rotatably engaging a surface of the machine frame.

8. Plate changing device comprising a roller disposed parallel to a plate cylinder having a plate lock-up device, positioning means for pressing the roller against the plate cylinder and for inserting a rear edge of a printing plate into said plate lock-up device, and guide means extending in a direction in which the rear edge of the printing plate is insertable in said plate lock-up device and displaceably supporting said roller at ends thereof, said guide means comprising a pair of guides secured to a machine frame, said positioning means comprising two positioning elements firmly connected to said machine frame and supporting said roller at each of said ends thereof, respectively, a pair of displaceable bearings respectively holding said roller in said pair of guides, said roller being removable from said bearings, and including respective bushings displaceable by said positioning elements, said bearings being disposed in said bushings, said bushings being displaceable along said guides radially to the plate cylinder.

9. Plate changing device according to claim 8, including spring means in said bushings, said bearings being displaceable outwardly from the plate cylinder against a biasing force of said spring means, said biasing force being of such size that danger of injury to a hand present between the plate cylinder and said roller is minimal.

10. Plate changing device according to claim 9, including a switch for signalling stoppage of the printing machine, and lever means for transmitting a displacement of said bearings in said bushings to said switch.

11. Plate changing device comprising a roller disposed parallel to a plate cylinder having a plate lock-up device, positioning means for pressing the roller against the plate cylinder and for inserting a rear edge of a printing plate into said plate lock-up device, and guide means extending in a direction in which the rear edge of the printing plate is insertable in said plate lock-up device and displaceably supporting said roller at ends thereof, said guide means comprising a pair of guides secured to a machine frame, said positioning means comprising two positioning elements firmly connected to said machine frame and supporting said roller at each of said ends thereof, respectively, a pair of displaceable bearings respectively holding said roller in said pair of guides, said roller being removable from said bearings, said roller being formed of an inner and an outer tube, said inner tube receiving therein part of said bearings, and roller bearings supporting said outer tube on said inner tube.

12. Plate changing device according to claim 11, including means for removing said roller from the device by an operator without a tool.

13. Plate changing device according to claim 11, wherein said roller is formed with projecting rings of elastic material disposed over the cylindrical surface of said roller.

14. Plate changing device according to claim 13, wherein said elastic material is rubber.

* * * * *